US006322605B1

(12) United States Patent
He et al.

(10) Patent No.: US 6,322,605 B1
(45) Date of Patent: Nov. 27, 2001

(54) DIESEL EXHAUST FILTERS

(75) Inventors: Lin He, Horseheads; Gregory A. Merkel, Big Flats; Cameron W. Tanner, Horseheads; Dale R. Wexell, Corning, all of NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/584,932

(22) Filed: May 31, 2000

(51) Int. Cl.[7] ..... B01D 39/20
(52) U.S. Cl. ..... 55/523; 55/DIG. 30; 60/311
(58) Field of Search ..... 55/523, 524, DIG. 10, 55/DIG. 30; 423/213.2, 213.5; 60/311, 303

(56) References Cited

U.S. PATENT DOCUMENTS

| | | | | |
|---|---|---|---|---|
| 4,329,162 | | 5/1982 | Pitcher, Jr. . | |
| 4,477,771 | * | 10/1984 | Nagy et al. | 324/58.5 |
| 4,781,831 | | 11/1988 | Goldsmith . | |
| 5,009,781 | | 4/1991 | Goldsmith . | |
| 5,087,272 | | 2/1992 | Nixdorf . | |
| 5,108,601 | | 4/1992 | Goldsmith . | |
| 5,622,680 | * | 4/1997 | Monceaux et al. | 423/213.5 |

FOREIGN PATENT DOCUMENTS

| | | |
|---|---|---|
| 0 420 513 | 1/1995 | (EP) . |
| 6-241022 | 8/1994 | (JP) . |

OTHER PUBLICATIONS

"Preparation of Bulk and Supported Perovskites", Twu and Gallagher, Chapter 1, pp. 1–9, Properties an Applications of Perovskite–Type Oxides.

"Development of a Microwave Assisted Regeneration System for a Ceramic Diesel Particulate System" Gautam et al., SAE Technical Paper Series 1999–01–3565, pp. 1–16.

Application 60/157,895 filed Oct. 5, 1999.

* cited by examiner

*Primary Examiner*—Robert A. Hopkins
(74) *Attorney, Agent, or Firm*—Anca C. Gheorghiu

(57) ABSTRACT

A filter for trapping and combusting diesel exhaust particulates comprising a microwave-absorbing filter body formed from a ceramic material having a general formula selected from the group consisting of $A_{1-x}M_xB_{1-y}M'_yO_{3-\alpha}$, where A and M are selected from the group consisting of Na, K, Rb, Ag, Ca, Sr, Ba, Pb, La, Pr, Nd, Bi, Ce, Th and combinations thereof; where B and M' are selected from the group consisting of Ti, V, Cr, Mn, Fe, Co, Ni, Rh, Ru, Pt, Zn, Nb, Ta, Mo, W and combinations thereof; wherein, the chemical formula is electrostatically balanced; $(A'_aR_rM''_m)(Z)_4(X)_6O_{24}$, where A' is from Group IA metals; where R is selected from Group IIA metals; where M" is selected from the group consisting of Mn, Co, Cu, Zn, Y, lanthanides and combinations thereof; where Z is selected from the group consisting of Zr, Hf, Ti, Nb, Ta, Y, lanthanides, Sn, Fe, Co, Al, Mn, Zn, Ni, and combinations thereof; where X is selected from the group consisting of P, Si, As, Ge, B, Al, and combinations thereof; wherein, the chemical formula is electrostatically balanced.

14 Claims, No Drawings

DIESEL EXHAUST FILTERS

CROSS-REFERENCE TO RELATED APPLICATIONS

An application entitled MICROWAVE REGENERATED DIESEL PARTICULATE FILTER AND METHOD OF MAKING THE SAME, filed under Ser. No. 09/583,500 in the names of L. He, G. Merkel, C. Tanner, and D. Wexell and assigned to the same assignee as this application, is directed to a filter for trapping and combusting diesel exhaust particulates comprising a monolithic substrate and a coating of a microwave-absorbing material and a method of making the same.

BACKGROUND OF THE INVENTION

The present invention relates to filters for use in exhaust streams for capturing particulate material. In particular the present invention relates to porous ceramic diesel exhaust filters which can be regenerated by microwave energy.

Recently much interest has been directed towards the diesel engine due to its efficiency, durability and economical aspects. However, diesel emissions have come under attack both in the United States and Europe, for their harmful effects on the environment and on humans. As such, stricter environmental regulations will require diesel engines to be held to the same standards as gasoline engines. Therefore, diesel engine manufacturers and emission-control companies are working to achieve a diesel engine which is faster, cleaner and meets the most stringent of requirements under all operating conditions with minimal cost to the consumer.

One of the biggest challenges in lowering diesel emissions is controlling the levels of diesel particulate material (DPM) present in the diesel exhaust stream. In 1998 DPM was declared a toxic air contaminant by the California Air Resources Board. As mentioned herein above legislation has been passed that regulates the concentration and particle size of DPM pollution originating from both mobile and stationary sources.

DPM which is mainly carbon particulates, is also known as soot. One way of removing diesel soot from the diesel exhaust is through diesel traps. The most widely used diesel trap is the diesel particulate filter (DPF) which is used to capture the soot. The DPF is designed to provide for nearly complete filtration of the soot without hindering the exhaust flow. However, as diesel soot accumulates, exhaust flow becomes increasingly difficult and the DPF must either be replaced or the accumulated diesel soot must be cleaned out. Cleaning the accumulated diesel soot from the DPF is achieved via burning-off or oxidation to $CO_2$ and is known in the art as regeneration. Regeneration is considered to be a superior approach over DPF replacement since no interruption for service is necessary.

The regeneration process can be either passive or active. In a passive system, regeneration occurs when the DPF becomes so filled with carbon particulates that heat accumulated in the exhaust system due to excessive back pressure raises the temperature of the carbon to a point where it ignites. This design can result in thermal shock or melt down of the filter, high fuel penalty and poor filtering action. Active regeneration is considered to be a superior approach over passive regeneration. In an active system, heat required to initiate combustion of the soot is generated by an outside source. Electrical power, fuel burners and microwave energy have all been studied as heat sources. Microwave energy is considered to be a superior approach over electrical power and fuel burners because it is highly efficient cost- and energy-wise.

Microwave regeneration has been addressed, for example in U.S. Pat. No. 5,087,272 (Nixdorf) which discloses a microwave regenerated filter made of single crystal silicon carbide whiskers which are consolidated into a preform of cylindrical configuration or into a thin layer such as a paper, which is then folded into a multicellular form. A problem associated with the proposed filter is that it is labor intensive and time consuming to manufacture, and hence not adaptable to high efficiency production methods.

Standard commercially available filters are made of cordierite ($2MgO\text{-}2Al_2O_3\text{-}5SiO_2$). However, cordierite is transparent to microwaves and is not regenerable upon exposure to microwave energy.

Therefore a need exists for a filter for trapping and combusting particulates from a diesel exhaust stream which can undergo regeneration by microwave energy and which can be manufactured according to high efficiency production methods (i.e., extrusion), while at the same time exhibiting a high filtration efficiency.

It is the purpose of the present invention to provide such a filter.

SUMMARY OF THE INVENTION

The present invention provides a filter for trapping and combusting diesel exhaust particulates comprising a microwave-absorbing filter body formed from a refractory oxide ceramic material having a loss tangent which decreases with increasing temperature, such that upon exposure to a microwave source the temperature of the filter as a function of time reaches an equilibrium at about 1100° C., and preferably around 900–1000° C.

In particular the refractory oxide ceramic material is selected from the group consisting of $A_{1-x}M_xB_{1-y}M'_yO_{3-\alpha}$, where A and M are selected from the group consisting of Na, K, Rb, Ag, Ca, Sr, Ba, Pb, La, Pr, Nd, Bi, Ce, Th and combinations thereof; where B and M' are selected from the group consisting of Ti, V, Cr, Mn, Fe, Co, Ni, Rh, Ru, Pt, Zn, Nb, Ta, Mo, W and combinations thereof; wherein, the chemical formula is electrostatically balanced;$(A'_aR_rM''_m)(Z)_4(X)_6O_{24}$, where A' is from Group IA metals; where R is selected from Group IIA metals; where M" is selected from the group consisting of Mn, Co, Cu, Zn, Y, lanthanides and combinations thereof; where Z is selected from the group consisting of Zr, Hf, Ti, Nb, Ta, Y, lanthanides, Sn, Fe, Co, Al, Mn, Zn, Ni, and combinations thereof; where X is selected from the group consisting of P, Si, As, Ge, B, Al, and combinations thereof; wherein, the chemical formula is electrostatically balanced.

In particular the filter body of the present invention is a honeycomb substrate having an inlet and outlet end and a multiplicity of cells extending from said inlet end to said outlet end, said cells having porous walls, wherein part of the total number of cells at said inlet end are plugged along a portion of their lengths, and the remaining part of cells that are open at said inlet end are plugged at said outlet end along a portion of their lengths, so that a gaseous stream passing through the cells of said honeycomb from said inlet end to said outlet end flows into said open cells, through said cell walls and out of said honeycomb substrate through said open cells at said outlet end, and having a cell density in the range of about 100–300 cells/in$^2$, and a cell wall thickness in the range of about 0.008–0.030 inches.

In particular the filters have an open porosity of at least 25% by volume, a pore diameter in the range of 10 to 50 microns, and a filtration efficiency of at least 90%.

DETAILED DESCRIPTION OF THE INVENTION

The inventive filters are regenerated upon exposure to a source of microwaves. The body of the filter is made from a microwave—absorbing material that is highly efficient at converting the absorbed microwaves into thermal energy. Materials which are microwave absorbers are well known in the art (e.g., EP 420 513 B1). A material's ability to absorb microwaves is dictated by its dielectric constant; materials with large dielectric constants are good absorbers of microwave energy. It has been found, however, that not all materials which are good absorbers of microwave energy are suitable as materials for the present invention.

A more important material property in the materials of the present invention is the loss tangent, tan δ. The loss tangent is defined as the ratio of the dielectric loss factor to the dielectric permittivity and indicates a material's ability to convert microwave energy into thermal energy; the larger the loss tangent the greater the ability of a material to convert all of the absorbed microwave energy into thermal energy.

It has been found that materials suitable for the filters of the present invention generally belong to the following groups of refractory oxide ceramic compositions, have a large loss tangent at a frequency of 2.45 GHz, and have a loss tangent which is inversely proportional with temperature. In explanation, as microwaves are absorbed and converted into thermal energy the temperature of the filter increases; as the temperature of the filter increases the loss tangent of materials of the present invention decreases. Hence, even through the same amount of microwaves may be absorbed, less are converted into thermal energy. Therefore, the temperature of the filter reaches an equilibrium, preferably at about 1100° C., and most preferably at about 900–1000° C. upon continued exposure to a source of microwaves.

In one embodiment the material has an NZP-type structure. As used herein an "NZP-type structure" refers to a solid phase in which the arrangement of atoms is generally similar to that of the type compound $NaZr_2P_3O_{12}$, but in which some or all of the sodium, zirconium, or phosphorous is replaced by other substituent atoms. Also, additional atoms may be substituted into the crystal lattice sites that are vacant in $NaZr_2P_3O_{12}$, but which are fully occupied in the $Na_4Zr_2Si_3O_{12}$ structure which is also an NZP-type structure.

This series of ceramic compositions is represented by the general formula$(A'_aR_rM''_m)(Z)_4(X)_6O_{24}$, where A' represents one or more Group IA metals; where R represents one or more Group IIA metals; where M" is selected from the group consisting of Mn (manganese), Co (cobalt), Cu (copper), Zn (zinc), Y (yttrium) and the lanthanide metals and combinations thereof; where Z is selected from the group consisting of Zr (zirconium), Hf (hafnium), Ti (titanium), Nb (niobium), Ta (thalium), Y, lanthanides, Sn (tin), Fe (iron), Co, Al (aluminium), Mn, Zn, Ni (nickel), and combinations thereof; where X is selected from the group consisting of P (phosphorous), Si (silicon), As (arsenic), Ge (germanium), B (boron), Al (aluminum), and combinations thereof; and, where the chemical formula is electrostatically balanced, i.e., the charges of the elements add up to a value of zero.

An especially suited formula for the inventive materials where A' is Na, Z is Zr, and X is P or Si, is $Na_{1+w}Zr_2P_{3-w}Si_wO_{12}$. In an especially preferred embodiment the value of w is 1.0 to 2.75. When the value of w is 1.5 the chemical formula for the specific composition can be written as $Na_{2.5}Zr_2P_{1.5}Si_{1.5}O_{12}$, and the resulting ceramic has an ultra low coefficient of thermal expansion and good thermal shock resistance. When the value of w is 2 the chemical formula the specific composition can be written as $Na_3Zr_2PSi_2O_{12}$, and the resulting ceramic also has an ultra low coefficient of thermal expansion and good thermal shock resistance. Although not intended to be bound by theory, it is believed that these compositions are heatable in a microwave energy field due to the movement of the sodium cations within the channels of the NZP crystal structure.

In another embodiment the material has a Perovskite-type structure which is non-stoichiometric in oxygen. The composition of this material is represented by the general formula $A_{1-x}M_xB_{1-y}M'_yO_{3-\alpha}$, where A and M are selected from the group of the elements Na (sodium), K (potassium), Rb (rubidium), Ag (silver), Ca (calcium), Sr (strontium), Ba (barium), Pb (lead), La (lanthanum), Pr (praseodymium), Nd (neodymium), Bi (bismuth), Ce (cerium), Th (thorium); where B and M' are from the group of the elements Ti (titanium), V (vanadium), Cr (chromium), Mn (manganese), Fe (iron), Co (cobalt), Ni (nickel), Rh (rhodium), Ru (ruthenium), Pt (platinum), Zn (zinc), Nb (niobium), Ta (thalium), Mo (molybdenum) and W (tungsten); and, where the chemical formula is electrostatically balanced, i.e., the charges of the elements add up to a value of zero. These ceramics are non-stochiometric in oxygen because in the formula the number of oxygen ions is not always equal to three. More specifically the value of $3-\alpha$ can vary from 2.9 to 3.1.

An especially suited formula is $A_{1-x}M_xB_{1-y}M'_yO_{3-\alpha}$; where A and M are selected from the group of elements La, Bi, Sr and combinations thereof; where B and M' are selected from the group of elements $Mn^{3+}$, $Mn^{4+}$, Pt, Zn, Co, Ru, Fe, Cu, $Ti^{3+}$, $Ti^{4+}$ and combinations thereof; and, where the chemical formula is electrostatically balanced, i.e., the charges of the elements add up to a value of zero. A most preferred formula is $LaMn_{1-y}M'_yO_{3-\alpha}$, where M' is one or more of the metals Pt, Ru, Fe, Zn, Cu, and combinations thereof and where $0 \leqq y \leqq 0.2$. For example a specific composition within this most preferred formula is $LaMn_{0.8}Pt_{0.2}O_{3-\alpha}$. Although not intended to be bound by theory, it is believed that these materials are heatable in a microwave energy field due to electronic conduction.

Another most preferred formula is $La_{1-x}Sr_xM'\ O_{3-\alpha}$, where M' is one or more of the metals Mn, Co, and combinations thereof, and where $0 \leqq x \leqq 0.2$. For example a specific composition within this most preferred formula is $La_{0.8}Sr_{0.2}MnO_{3-\alpha}$. Another example is $La_{0.8}Sr_{0.2}CoO_{3-\alpha}$. Although not intended to be bound by theory, it is believed that these materials are heatable in a microwave energy field due to electronic conduction.

For the NZP-type structure the raw materials are metal oxide sources that react to form the NZP phase. Sources of sodium include, for example, $Na_2CO_3$, $Na_2ZrO_3$ or a sodium phosphate or sodium phosphate hydrate compound; sources for Zr include, for example, $Na_2ZrO_3$, $ZrO_2$, $ZrSiO_4$, $ZrP_2O_7$, $Zr_2P_2O_9$, $Zr(HPO_4)_2$-$xH_2O$, $Zr(OH)_4$, $ZrOCl_2$-$xH_2O$, zirconyl nitrate zirconyl carbonate, and zirconium acetate; sources for P include, for example, $H_3PO_4$, $NH_4H_2PO_4$, $(NH_4)_2HPO_4$, $(NH_4)_3PO_4$, $ZrP_2O_7$, $Zr_2P_2O_9$, $Zr(HPO_4)_2$-$xH_2O$, and sources for Si include, for example, colloidal silica, fused silica, zeolites, quartz, cristobalite, tridymite, $ZrSiO_4$, silicone oils or resins, and other silicon organometallic compounds such as tetraethylorthosilicate.

The Perovskite-forming raw materials are metal oxide sources that react to form the Perovskite phase. Metal salts like nitrates, sulfates, acetates, oxides, carbonates and chlorides are preferred. In the formulas above, for example a source for La is $La(NO_3)_3$; a source of Mn is $Mn(NO_3)_2$; a source of Pt is $(NH_3)_4Pt(NO_3)_2$; a source of Ru is $Ru(NO_3)_3$; a source of Fe is $Fe_2O_3$; a source of Cu is $Cu(NO_3)_2$; a source of Sr is $SrCO_3$; a source of Co is $Co_2O_3$; a source of Li is $Li_2CO_3$; a source of Na is $Na_2CO_3$; a source of Zr is $ZrO_2$; and a source of Nb is $Nb_2O_5$.

Sintering additives can also be included optionally in the forming mixture. Addition of the sintering aid is sometimes necessary for the structure to have adequate strength after firing. It is preferred that the sintering additive, when it is used, be present in the mixture at a level of about 0.05 wt % to 10.0 wt %, and more preferably, about 0.1 wt % to 1.0 wt % of the raw material composition. For example for the NZP-type structure, suitable sintering additives generally include an oxide source of one or more metals such as magnesium, zinc, calcium, aluminum, lanthanum, titanium, bismuth, or tungsten.

The mixture may also optionally include a pore former. A pore former is a fugitive particulate material which evaporates or undergoes vaporization by combustion during drying or heating of the green body to obtain a desired, usually larger porosity and/or coarser median pore diameter than would be obtained otherwise. When a pore former is used, it is advantageous that it be a particulate pore former and be present in an amount of at least about 10% by weight based on the raw materials. In this case the median particle size of the particulate pore former is preferably at least about 10 micrometers. One especially suitable particulate pore former is graphite having a median particle size of at least about 10 micrometers, and more preferably at least 25 micrometers.

The raw materials are mixed together. If included, the sintering aid can be added as a powder or liquid form to the mixture and further blended with the raw materials.

As much as 60% of a pore-former can also be added to the powder mixture to further increase the permeability of the fired body.

The mixture is optionally mixed with a liquid, binder, lubricant, and plasticizer and shaped into a green body by any ceramic forming method known in the art, such as injection molding, slip casting, dry pressing. Preferably, extrusion is employed.

The extrusion operation can be done using a hydraulic ram extrusion press, or a two stage de-airing single auger extruder, or a twin screw mixer with a die assembly attached to the discharge end. In the latter, the proper screw elements are chosen according to material and other process conditions in order to build up sufficient pressure to force the batch material through the die. The extrusion can be vertical or horizontal.

The resulting shaped green structure is then dried and heated to a maximum temperature of about 1200° C. to 1750° C. over a period of about 2 to 200 hours, preferably 10 to 100 hours, and held at the maximum temperature for 0.1 to 100 hours, preferably 1 to 30 hours. The firing may be conducted in an electrically heated furnace or gas kiln. The partial pressure of oxygen in the firing atmosphere is preferably at least 0.01 atmospheres, and more preferably at least 0.10 atmospheres, especially when the hold temperature is greater than about 1450° C. Higher hold temperatures and longer hold times are advantageous for increasing the strength and median pore size of the structure, and can also reduce the coefficient of thermal expansion.

Although the filter structure of the present invention can have any shape or geometry, it is preferred that the filter body of the present invention be a multicellular structure such as a honeycomb structure. The honeycomb structure has an inlet and outlet end or face, and a multiplicity of cells extending from the inlet end to the outlet end, the cells having porous walls. Generally honeycomb cell densities range from about 93 cells/cm$^2$ (600 cells/in$^2$) to about 4 cells/cm$^2$ (25 cells/in$^2$).

A portion of the cells at the inlet end or face are plugged with a paste having same or similar composition to that of the green body, as described in U.S. Pat. No. 4,329,162 which is herein incorporated by reference. The plugging is only at the ends of the cells which is typically to a depth of about 9.5 to 13 mm, although this can vary. A portion of the cells on the outlet end but not corresponding to those on the inlet end are plugged. Therefore, each cell is plugged only at one end. The preferred arrangement is to have every other cell on a given face plugged as in a checkered pattern.

This plugging configuration allows for more intimate contact between the exhaust stream and the porous wall of the substrate. The exhaust stream flows into the substrate through the open cells at the inlet end, then through the porous cell walls, and out of the structure through the open cells at the outlet end. Filters of the type herein described are known as a"wall flow" filters since the flow paths resulting from alternate channel plugging require the exhaust being treated to flow through the porous ceramic cell walls prior to exiting the filter.

Other suitable filter structures are cross flow structures such as those disclosed in U.S. Pat. Nos. 4,781,831, 5,009, 781 and 5,108,601 which are herein incorporated by reference.

The inventive filters have cellular densities between about 10 and 300 cells/in$^2$ (about 1.5 to 46.5 cells/cm$^2$), more typically about 100 and 200 cells/in$^2$ (about 15.5 to 31 cells/cm$^2$). Wall thickness can vary upwards from the minimum dimension providing structural integrity, of about 0.002 in. (about 0.05 mm), but is generally less than about 0.06 in. (1.5 mm) to minimize the fraction of the filter volume occupied by the filter wall. A range between about 0.010 and 0.030 inches (about 0.25 mm and 0.76 mm) e.g., 0.017 inches, is most often selected as the preferred wall thickness.

Interconnected open porosity of the filter walls may vary, but is most generally greater than about 25% of the wall volume and usually greater than about 35% to allow flow through the wall. Diesel filter integrity and filter strength becomes questionable above about 70% open pore volume; volumes of about 50% are therefore typical. It is believed that the open porosity may be provided by pores in the channel walls having mean diameters in the range of about 1 to 60 microns, with a preferred range between about 10 and 50 microns.

Filtration efficiencies up to and in excess of 90% of the diesel exhaust particulate matter (by weight) can be achieved with the described structures. Efficiencies, of course, will vary with the range and distribution of the size of the particulates carried within the exhaust stream. Volumetric porosity and mean pore size are typically specified as determined by conventional mercury-intrusion porosimetry.

The inventive filters are regenerated upon exposure to a source of microwaves at a frequency of 2.45 GHz at an energy of about 600 to 1100 watts. It has been found that this frequency couples well with the inventive filters to convert microwave energy into the thermal energy required to burn trapped carbon particulates. It has also been found that the temperature of the filters as measured as a function of time reaches an equilibrium around 1100° C., and preferably around 900–1000° C.

Although the present invention has been fully described by way of examples, it is to be noted that various changes and modifications will be apparent to those skilled in the art. Therefore, unless otherwise such changes and modifications depart from the scope of the present invention, they should be construed as included therein.

What is claimed is:

1. A filter for trapping and combusting diesel exhaust particulates comprising a microwave-absorbing filter body formed from a refractory oxide ceramic material having a large loss tangent at 2.45 GHz, wherein said refractory oxide ceramic material has a general formula of:

$$(A'_aR_rM''_m)(Z)_4(X)_6O_{24},$$

where A' is from Group IA metals; where R is selected from Group IIA metals; where M" is selected from the group consisting of Mn, Co, Cu, Zn, Y, lanthanides and combinations thereof; where Z is selected from the group consisting of Zr, Hf, Ti, Nb, Ta, Y, lanthanides, Sn, Fe, Co, Al, Mn, Zn, Ni, and combinations thereof; where X is selected from the group consisting of P, Si, As, Ge, B, Al, and combinations thereof; wherein, said chemical formula is electrostatically balanced.

2. The filter of claim 1 wherein said filter body is a honeycomb substrate having an inlet and outlet end and a multiplicity of cells extending from said inlet end to said outlet end, said cells having porous walls, wherein part of the total number of cells at said inlet end are plugged along a portion of their lengths, and the remaining part of cells that are open at said inlet end are plugged at said outlet end along a portion of their lengths, so that a gaseous stream passing through the cells of said honeycomb from said inlet end to said outlet end flows into said open cells, through said cell walls and out of said honeycomb substrate through said open cells at said outlet end.

3. The filter of claim 1 wherein said composition is $LaMn_{1-y}M'_yO_{3-\alpha}$; where M' is selected from the group of metals consisting of Pt, Ru, Fe, Zn, Cu, and combinations thereof, and $0 \leqq y \leqq 0.2$.

4. The filter of claim 3 wherein said composition is $LaMn_{0.8}Pt_{0.2}O_{3-\alpha}$.

5. The filter of claim 1 wherein said composition is $Na_{1+w}Zr_2P_{3-w}Si_wO_{12}$ and the value of w is between 1.0 and 2.75.

6. The filter of claim 5 wherein said composition is $Na_{2.5}Zr_2P_{1.5}Si_{1.5}O_{12}$.

7. The filter of claim 5 wherein said composition is $Na_3Zr_2PSi_2O_{12}$.

8. A diesel particulate filter comprising a plugged, wall-flow honeycomb filter body composed of a porous ceramic material and comprising of a plurality of parallel end-plugged cell channels traversing the body from a frontal inlet end to an outlet end thereof wherein, said ceramic material having a general formula of $$(A'_aR_rM''_m)(Z)_4(X)_6O_{24},$$

where A' is from Group IA metals; where R is selected from Group IIA metals; where M" is selected from the group consisting of Mn, Co, Cu, Zn, Y, lanthanides and combinations thereof; where Z is selected from the group consisting of Zr, Hf, Ti, Nb, Ta, Y, lanthanides, Sn, Fe, Co, Al, Mn, Zn, Ni, and combinations thereof; where X is selected from the group consisting of P, Si, As, Ge, B, Al, and combinations thereof; wherein, said chemical formula is electrostatically balanced.

9. A diesel particulate filter in accordance with claim 8 which has a cell density in the range of about 100–300 cells/in$^2$, and a cell wall thickness in the range of about 0.008–0.030 inches.

10. A filter for trapping and combusting diesel exhaust particulates comprising a microwave-absorbing filter body formed from a refractory oxide ceramic material having a large loss tangent at 2.45 GHz, wherein said refractory oxide ceramic material has a general formula of:

$$LaMn_{1-y}M'_yO_{3-\alpha},$$

where M' is selected from the group of metals consisting of Pt, Ru, Fe, Zn, Cu, and combinations thereof, and $0 \leqq y \leqq 0.2$.

11. The filter of claim 10 wherein said composition is $LaMnO_{0.8}Pt_{0.2}O_{3-\alpha}$.

12. A filter for trapping and combusting diesel exhaust particulates comprising a microwave-absorbing filter body formed from a refractory oxide ceramic material having a large loss tangent at 2.45 GHz, wherein said refractory oxide ceramic material has a general formula of:

$$Na_{1+w}Zr_2P_{3-w}Si_wO_{12}$$

and the value of w is between 1.0 and 2.75.

13. The filter of claim 12 wherein said composition is $Na_{2.5}Zr_2P_{1.5}Si_{1.5}O_{12}$.

14. The filter of claim 12 wherein said composition is $Na_3Zr_2PSi_2O_{12}$.

* * * * *

UNITED STATES PATENT AND TRADEMARK OFFICE

CERTIFICATE OF CORRECTION

PATENT NO. : 6,322,605 B1
DATED : November 27, 2001
INVENTOR(S) : He et al.

It is certified that error appears in the above-identified patent and that said Letters Patent is hereby corrected as shown below:

Column 8,
Line 33, " $LaMnO_{0.8}Pt_{0.2}O_{3-\alpha}$." should be -- $LaMn_{0.8}Pt_{0.2}O_{3-\alpha}$ --

Signed and Sealed this

Fourth Day of June, 2002

*Attest:*

*Attesting Officer*

JAMES E. ROGAN
*Director of the United States Patent and Trademark Office*